US010535298B2

(12) United States Patent
Yu

(10) Patent No.: US 10,535,298 B2
(45) Date of Patent: Jan. 14, 2020

(54) PIXEL CIRCUIT AND METHOD FOR DRIVING PIXEL CIRCUIT

(71) Applicant: SHENZHEN ROYOLE TECHNOLOGIES CO., LTD., Shenzhen (CN)

(72) Inventor: Xiaojun Yu, Shenzhen (CN)

(73) Assignee: SHENZHEN ROYOLE TECHNOLOGIES CO., LTD., Shenzhen, Guangdong (CN)

( * ) Notice: Subject to any disclaimer, the term of this patent is extended or adjusted under 35 U.S.C. 154(b) by 119 days.

(21) Appl. No.: 15/738,440

(22) PCT Filed: Aug. 7, 2015

(86) PCT No.: PCT/CN2015/086409

§ 371 (c)(1),
(2) Date: Dec. 20, 2017

(87) PCT Pub. No.: WO2017/024454

PCT Pub. Date: Feb. 16, 2017

(65) Prior Publication Data

US 2018/0190189 A1 Jul. 5, 2018

(51) Int. Cl.
*G09G 3/3225* (2016.01)
*G09G 3/3233* (2016.01)

(52) U.S. Cl.
CPC ..... *G09G 3/3225* (2013.01); *G09G 3/3233* (2013.01); *G09G 2300/0819* (2013.01);
(Continued)

(58) Field of Classification Search
CPC ..... G09G 3/32; G09G 3/3225; G09G 3/3233; G09G 2300/0876; G09G 2320/0233; G09G 2300/0819
See application file for complete search history.

(56) References Cited

U.S. PATENT DOCUMENTS 9,779,662 B1 * 10/2017 Zhang ..... G09G 3/3233
2009/0021287 A1 * 1/2009 Jang ..... G09G 3/3233 327/109

(Continued)

FOREIGN PATENT DOCUMENTS

CN 103236237 8/2013
CN 104658483 5/2015

(Continued)

OTHER PUBLICATIONS

Goh et al., "P-72: A Novel Pixel Circuit for Active-Matrix Organic Light-Emitting Diodes," SID International Symposium, 2003, pp. 494-497.

(Continued)

*Primary Examiner* — Vinh T Lam
(74) *Attorney, Agent, or Firm* — IPro, PLLC; Na Xu

(57) ABSTRACT

Disclosed are a pixel circuit and a method for driving the pixel circuit. The pixel circuit includes a light-emitting diode; a driving transistor; a first transistor connected between a data line and the driving transistor, a gate electrode of the first transistor being connected to a first scanning line; a second transistor connected between a first power line and the driving transistor, a gate electrode of the second transistor being connected to a second scanning line; a third transistor connected between a gate electrode of the driving transistor and the second transistor, a gate electrode of the third transistor being connected to a third scanning line; and a driving capacitor connected between the gate electrode of the driving transistor and the first power line, in which the driving transistor is further connected to a second power line via the light-emitting diode.

8 Claims, 8 Drawing Sheets

(52) U.S. Cl.
CPC ..... *G09G 2300/0842* (2013.01); *G09G 2300/0861* (2013.01); *G09G 2300/0876* (2013.01); *G09G 2320/0233* (2013.01)

(56) References Cited

U.S. PATENT DOCUMENTS

| | | | | |
|---|---|---|---|---|
| 2011/0175862 | A1* | 7/2011 | Umezaki ..... | G09G 3/3233 345/204 |
| 2014/0362063 | A1* | 12/2014 | Uchino ..... | G09G 3/3233 345/205 |
| 2015/0028766 | A1* | 1/2015 | Yang ..... | G09G 3/3225 315/240 |
| 2018/0174512 | A1* | 6/2018 | Yuan ..... | G09G 3/32 |

FOREIGN PATENT DOCUMENTS

| | | |
|---|---|---|
| JP | 2011170335 | 9/2011 |
| WO | 2009142033 | 11/2009 |

OTHER PUBLICATIONS

EPO, Office Action for EP Application No. 15900652, dated Feb. 26, 2019.
KIPO, Office Action for KR Application No. 1020187001363, dated Dec. 17, 2018.
SIPO, First Office Action for CN Application No. 201580002977, dated Jul. 27, 2018.

* cited by examiner

PIXEL CIRCUIT AND METHOD FOR DRIVING PIXEL CIRCUIT

CROSS-REFERENCE TO RELATED APPLICATIONS

The present application is a national phase entry under 35 U.S.C. § 371 of International Application No. PCT/CN2015/086409, filed Aug. 7, 2015, the entirety of which is incorporated herein by reference.

FIELD

The present disclosure relates to the field of light emitting display panel, and more particularly, to a pixel circuit capable of compensating a threshold voltage change, a method for driving the pixel circuit and a display panel having the pixel circuit.

BACKGROUND

As a current mode light-emitting device, an organic light-emitting diode (OLED for short) has been increasingly applied in high-performance organic light-emitting display panels. Referring to FIG. 1, the OLED display panel pixel circuit in the related art includes a driving transistor MD, a transistor M1 functioning as a switch, a capacitor $C_{ST}$ and an organic light-emitting device, i.e., 2T1C. The organic light-emitting device includes an organic light-emitting diode $D_{OLED}$ and an inductance capacitor $C_{OLED}$ of the organic light-emitting diode $D_{OLED}$. The transistor M1 is connected to a data signal $V_{DATA}$ and is controlled by a scanning signal $V_{SCAN}$. The driving transistor MD is connected to a pixel power supply $V_{DD}$ and is also connected to the data signal $V_{DATA}$ via the transistor M1. Two terminals of the capacitor $C_{ST}$ are connected respectively to the pixel power supply $V_{DD}$ and a node A between the transistor M1 and the driving transistor MD. The organic light-emitting diode $D_{OLED}$ and the inductance capacitor $C_{OLED}$ are connected in parallel between the transistor MD and an external power supply $V_{SS}$. The voltage of the external power supply $V_{SS}$ is lower than the voltage of the pixel power supply $V_{DD}$, for example, the voltage of the external power supply $V_{SS}$ can be the ground voltage. When a gate electrode of the transistor M1 responds to scanning signal $V_{SCAN}$ and conducts the transistor ML the capacitor $C_{ST}$ is charged based on the data signal $V_{DATA}$, and then the voltage in the capacitor $C_{ST}$ is applied on the gate electrode of the driving transistor MD, thereby conducting the driving transistor MD, so that the organic light-emitting device through which current flows emits light.

The current provided to the organic light-emitting device through the driving transistor MD can be calculated by following formula:

$$I_{OLED}=\tfrac{1}{2}*\beta(V_{GS}-V_{TH})^2 \qquad \text{formula 1}$$

$I_{OLED}$ is the current flowing through the organic light-emitting device. $V_{GS}$ is a voltage applied between the gate electrode and the source electrode of the driving transistor MD, and $V_{GS}$ is determined by a voltage across the $C_{ST}$. $V_{TH}$ is a threshold voltage of the driving transistor MD. β is a gain factor of the driving transistor MD, which is determined by a size of the device and a carrier mobility of a semiconductor. It can be seen from formula, the current flowing through the organic light-emitting device may be affected by the threshold voltage of the driving transistor MD. Since the threshold voltage of each transistor in the organic light-emitting display panel may be different from each other in a production process, as well as an electron mobility of each transistor. On this basis, the current $I_{OLED}$ generated in the circuit is variable even given the same $V_{GS}$, thereby resulting non-uniformity of brightness.

SUMMARY

Accordingly, embodiments of the present disclosure provide a pixel circuit, in which the influence of a change of a threshold voltage on brightness may be reduced.

In embodiments of the present disclosure, a pixel circuit is provided, including a light-emitting diode; a driving transistor; a first transistor connected between a data line and the driving transistor, a gate electrode of the first transistor being connected to a first scanning line; a second transistor connected between a first power line and the driving transistor, and a gate electrode of the second transistor being connected to a second scanning line; a third transistor connected between a gate electrode of the driving transistor and the second transistor, a gate electrode of the third transistor being connected to a third scanning line; and a driving capacitor connected between the gate electrode of the driving transistor and the first power line; in which, the driving transistor is further connected to a second power line via the light-emitting diode.

In embodiments of the present disclosure, a display panel is provided, including a plurality of pixel circuits described above arranged in an array; a scan driving unit, configured to provide scanning signals to the first scanning line, the second scanning line and the third scanning line respectively; a data driving unit, configured to provide a data signal to a data line; a first power supply, configured to provide a first voltage to the first power line; and a second power supply, configured to provide a second voltage to the second power line.

In embodiments of the present disclosure, a method for driving a pixel circuit is provided, the method is applied in a pixel circuit as described above, and the driving transistor has a threshold voltage. The method includes: conducting the first transistor, the second transistor, the third transistor and the driving transistor, such that potentials at both ends of the driving capacitor are the first voltage provided by the first power line; conducting the first transistor, the third transistor and the driving transistor, and cutting off the second transistor, such that a data voltage is output by the data line to the driving transistor via the first transistor, the driving capacitor discharges electricity to the data line via the third transistor, the driving transistor and the first transistor in turn until a potential of an end of the driving capacitor connected to the driving transistor being the sum of the data voltage and the threshold voltage; and conducting the second transistor, and cutting off the first transistor and the third transistor, such that the driving transistor is driven to be conducted by the driving capacitor, and a light-emitting element is driven to emit light by the first voltage provided by the first power line.

With the pixel circuit, the display panel and the method for driving the pixel circuit of the present disclosure, the current flowing through the light-emitting element is only related to the data signal provided by the data line, such that the influence of the change of the threshold voltage on the current flowing through the light-emitting element is reduced.

BRIEF DESCRIPTION OF THE DRAWINGS

The following drawings are intended to illustrate embodiments of the present disclosure in detail with reference to specific embodiments. It should be understood that, elements illustrated in drawings are not representative of actual size and ratio relationships and are merely illustrative, and should not to be construed as a limitation of the present disclosure.

DETAILED DESCRIPTION

In order to make purposes, technical solutions and advantages of embodiments of the present disclosure more clear, reference will be made in detail to embodiments of the present disclosure with accompanying drawings. It should be understood that, the embodiments described herein according to drawings are explanatory and illustrative, and are not construed to limit the present disclosure.

Figure 1:
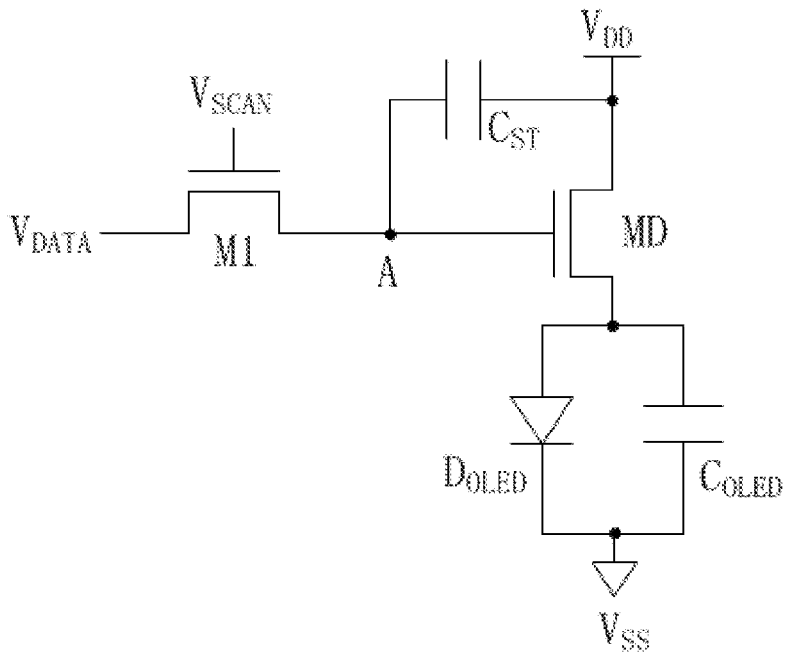
FIG. 1 is a schematic diagram of a pixel circuit in the related art.
Figure 2:
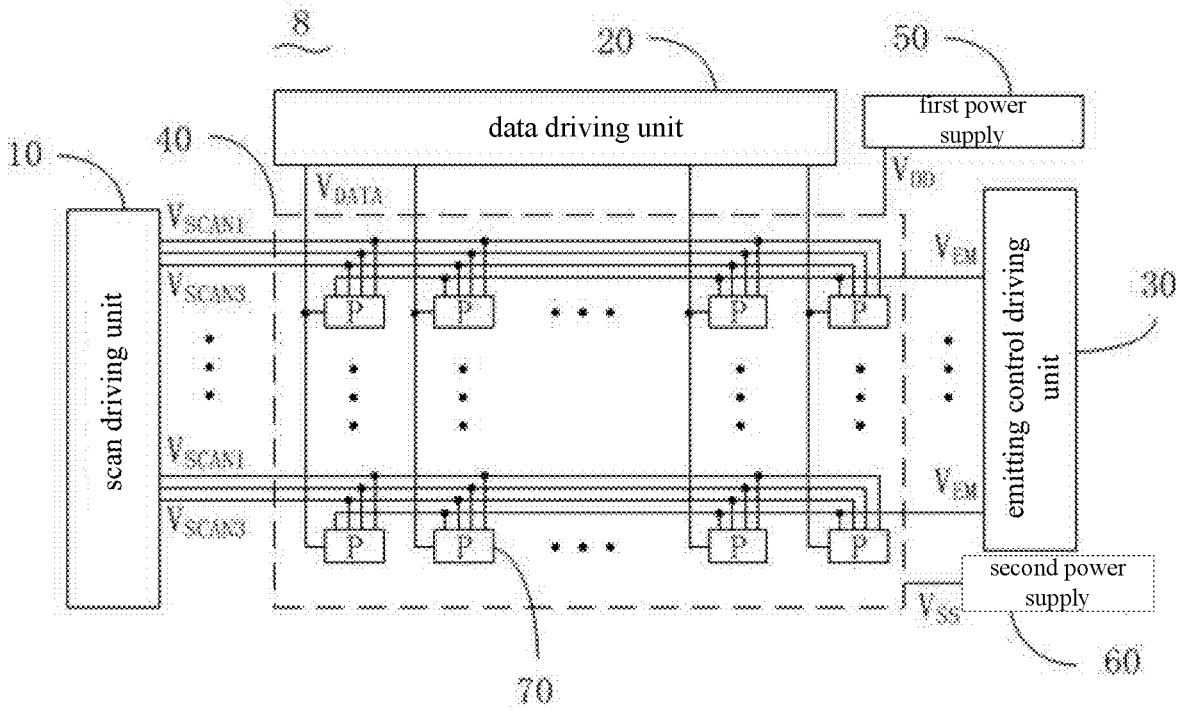
FIG. 2 is a schematic diagram of a display panel according to an embodiment of the present disclosure.

Referring to FIG. 2, a display panel 8 includes a scan driving unit 10, a data driving unit 20, a transmitting control driving unit 30, a display unit 40, a first power supply 50 and a second power supply 60. The display unit 40 includes a plurality of pixel circuits 70 arranged in a matrix. The scan driving unit 10, the data driving unit 20 and the transmitting control driving unit 30 are configured to provide a scanning signal $V_{SCAN}$ (including a first scanning signal $V_{SCAN1}$, a second scanning signal $V_{SCAN2}$ and a third scanning signal $V_{SCAN3}$), a data signal $V_{DATA}$ and an emitting control signal $V_{EM}$ to each pixel circuit 70, respectively. The first power supply 50, the second power supply 60 are configured to provide a first voltage $V_{DD}$ and a second voltage $V_{SS}$ to each pixel circuit 70, respectively.

Figure 3:
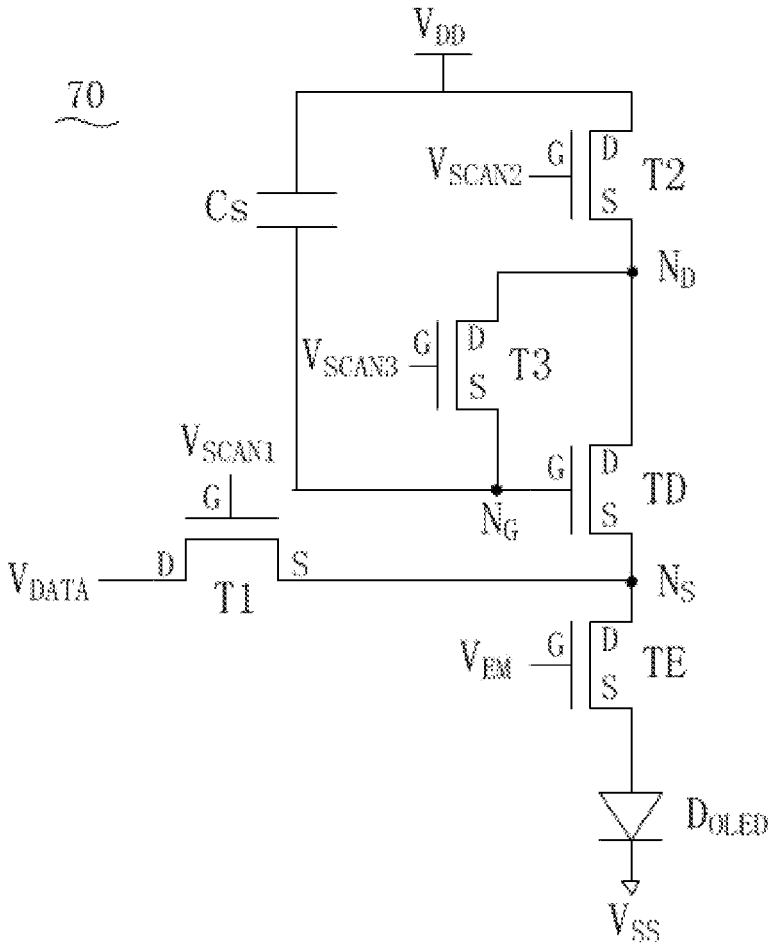
FIG. 3 is a schematic diagram of a pixel circuit of a display panel in FIG. 2 according to an embodiment of the present disclosure.

Referring to FIG. 3, in an embodiment of the present disclosure, the pixel 70 has a first scanning line configured to transmit a first scanning signal $V_{SCAN1}$, a second scanning line configured to transmit a second scanning signal $V_{SCAN2}$, a third scanning line configured to transmit a third scanning signal $V_{SCAN3}$, a first power supply configured to provide a first voltage $V_{DD}$, a second power supply configured to provide a second voltage $V_{SS}$, a data line configured to transmit a data signal $V_{DATA}$, and an emission line configured to transmit the emitting control signal $V_{EM}$.

Further, the pixel circuit 70 includes: a driving transistor TD; a light-emitting diode $D_{OLED}$, an electrode of the light-emitting diode $D_{OLED}$ being connected to the second power line; a first transistor T1, a control electrode of the first transistor T1 being connected to the first scanning line, and two controlled electrodes of the first transistor T1 being connected to the data line and a first controlled electrode of the driving transistor TD respectively; a second transistor T2, a control electrode of the second transistor T2 being connected to the second scanning line, and two controlled electrodes of the second transistor T2 being connected to the first power line and a second controlled electrode of the driving transistor TD respectively; a third transistor T3, a control electrode of the third transistor T3 being connected to the third scanning line, and two controlled electrodes of the third transistor T3 being connected to a control electrode and the second controlled electrode of the driving transistor TD respectively; an emitting transistor TE, a control electrode of the emitting transistor TE being connected to the emission line, and two controlled electrodes of the emitting transistor TE being connected to the first controlled electrode of driving transistor TD and another electrode of the light-emitting diode $D_{OLED}$ respectively; and a driving capacitor $C_{ST}$, two ends of the driving capacitor $C_{ST}$ being connected to the control electrode of the driving transistor TD and the first power line respectively.

In detail, in following embodiments, an organic light-emitting diode (OLDE for short) is an example of the light-emitting element. However, it should be understood that, the present disclosure is not limited to such an example, the light-emitting element may also be an inorganic light-emitting diode. In following embodiments, the driving transistor TD, the first transistor T1, the second transistor T2, the third transistor T3 and the emitting transistor TE are preferably thin-film field-effect transistors, and are specifically N-type thin-film field-effect transistors, but are not limited thereto, which may also be P-type thin-film field-effect transistors or other electronic devices capable of realizing switching functions, such as a triode. Those skilled in the art may know how transistors of other types operate according to descriptions of following embodiments, which will not be described in the present disclosure. In this case, a voltage value of the second voltage $V_{SS}$ is lower than a voltage value of the first voltage $V_{DD}$, such as a ground voltage.

The driving transistor TD includes a control electrode and two controlled electrodes controlled to be conducted or non-conducted by the control electrode, in which, the control electrode is a gate electrode G of the driving transistor TD, and the two controlled electrodes are a drain electrode D and a source electrode S. Similarly, the first transistor T1, the second transistor T2, the third transistor T3 and the emitting transistor TE are in the same way as the driving transistor TD. A drain electrode D and a source electrode S of the first transistor T1 are connected to the data line and a source electrode S of the driving transistor TD respectively, and a gate electrode G of the first transistor T1 is connected to the first scanning line. A drain electrode D and a source electrode S of the second transistor T2 are connected to the first power line and the drain electrode D of the driving transistor TD respectively, and a gate electrode G of the second transistor is connected to the second scanning line. A drain electrode D and a source electrode S of the third transistor T3 are connected to the source electrode S of the second transistor T2 and gate electrode G of the driving transistor TD respectively, and the gate electrode G of the third transistor T3 is connected to the third scanning line. A drain electrode D of the emitting transistor TE is connected to the source electrode S of the driving transistor TD, and a source electrode S of the emitting transistor TE is connected to the second power line via the light-emitting diode $D_{OLED}$. A cathode of the light-emitting diode $D_{OLED}$ is connected to the second power line, and a gate electrode G of the emitting transistor TE is connected to the emission line. In this embodiment, a node that connecting the first transistor T1, the driving transistor TD and the emitting transistor TE is defined as $N_G$, a node that connecting second transistor T2, the driving transistor TD and the third transistor T3 is defined as $N_D$, and a node that connecting the driving capacitor $C_{ST}$, the third transistor T3 and the driving transistor TD is defined as $N_G$.

Figure 4B:
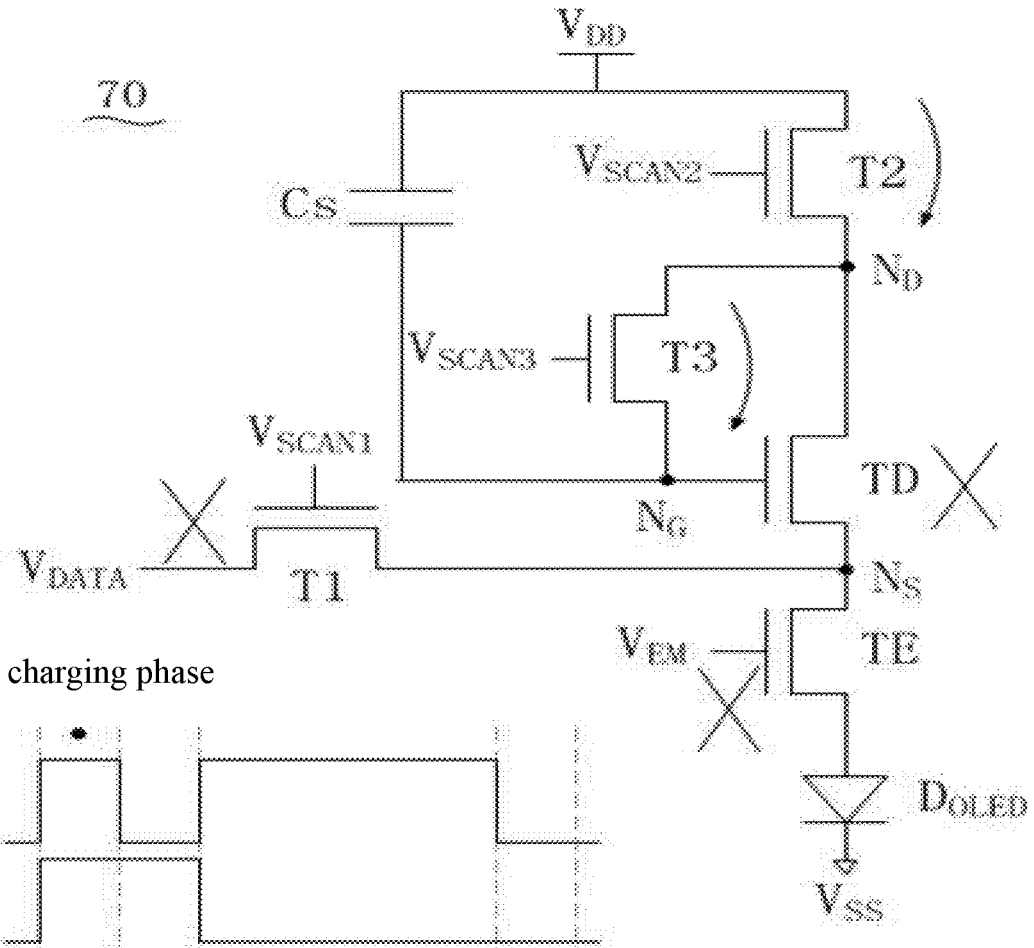
FIG. 4*b* is a schematic diagram of a pixel circuit in FIG. 3 at a charging phase of the timing diagram.
Figure 4A:
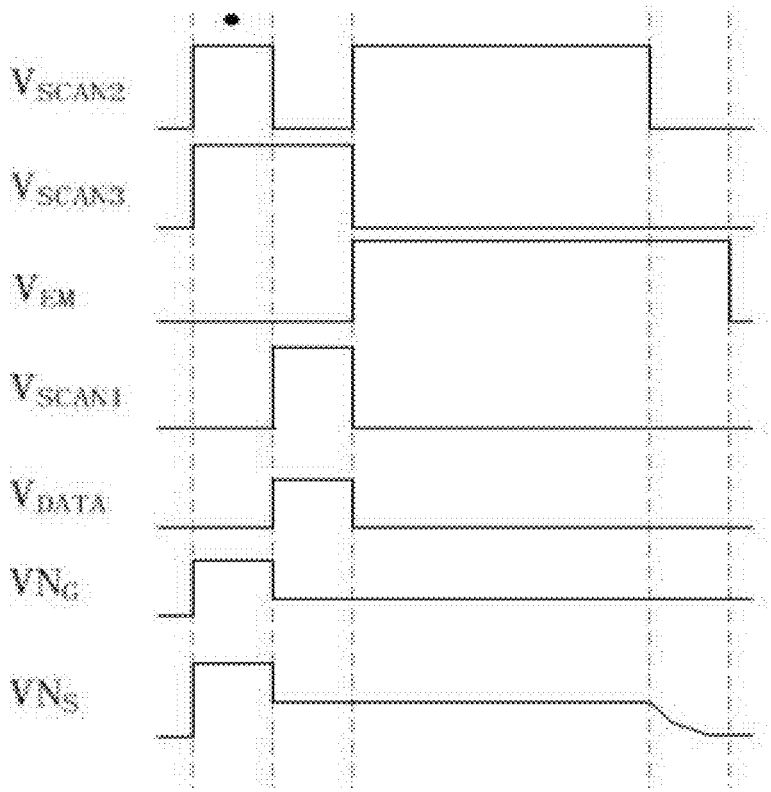
FIG. 4*a* is a timing diagram of a pixel circuit in FIG. 3.

Referring to FIG. 4*a* and FIG. 4*b*, the pixel circuit 70 in FIG. 3 is configured to be operating according to a timing diagram of an embodiment illustrated in FIG. 4*a*. In the timing diagram illustrated in FIG. 4*a*, each operating cycle of the pixel circuit 70 can be divided into four phases. At a first phase (i.e., a charging phase), an operating condition of the pixel circuit 70 is illustrated in FIG. 4*b*. At the charging phase, voltages of the node $N_D$ and the node $N_G$ are charged to be voltage of the first voltage $V_{DD}$. In detail, the first scanning signal $V_{SCAN1}$ and the emitting control signal $V_{EM}$ are low level signals, and the second scanning signal $V_{SCAN2}$ and the third scanning signal $V_{SCAN3}$ are high level signals. Moreover, the first transistor T1 and the emitting transistor TE are turned off, and the second transistors T2 and the third transistor T3 are conducted. In this case, the first voltage $V_{DD}$ is transmitted to the node $N_G$ via the second transistor T2 and the third transistor T3, i.e., both the node $N_G$ and the node $N_D$ are charged to be the first voltage $V_{DD}$. The driving transistor TD is also turned off under such a condition. The data signal $V_{DATA}$ may be a low level signal at this phase.

Figure 5B:
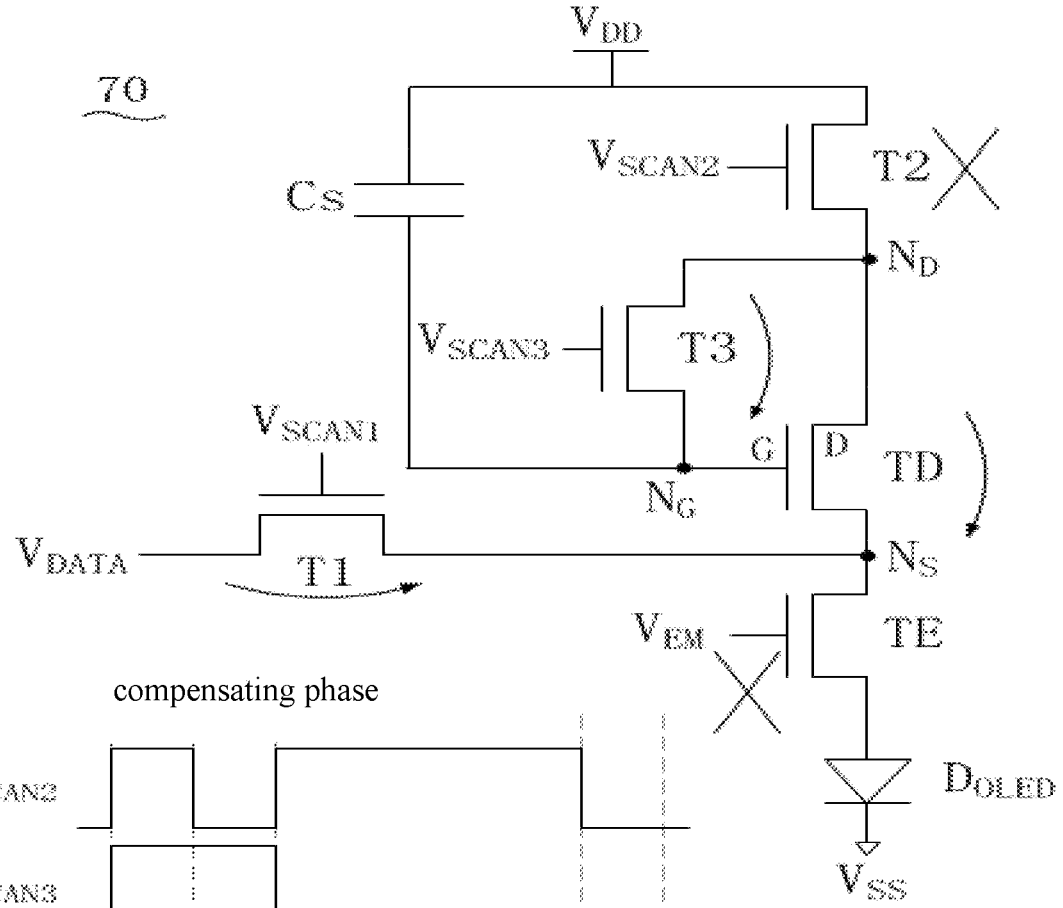
FIG. 5*b* is a schematic diagram of a pixel circuit in FIG. 3 at a compensating phase of the timing diagram.
Figure 5A:
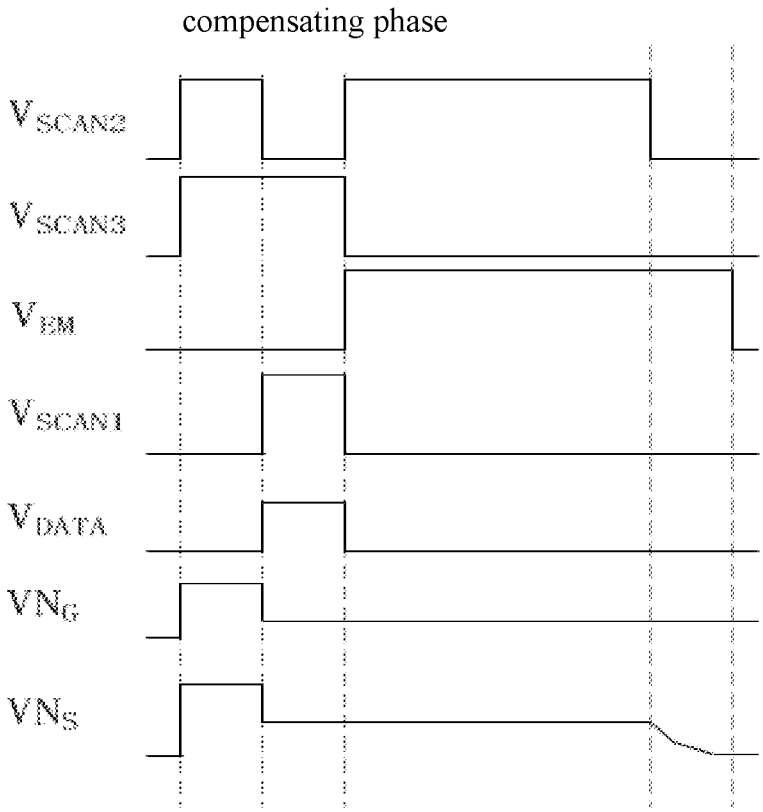
FIG. 5*a* is a timing diagram of a pixel circuit in FIG. 3.

Referring to FIG. 5*a* and FIG. 5*b*, at a second phase (i.e., a compensating phase), the node $N_D$ and $N_G$ are charged to be the sum of voltages of the data signal $V_{DATA}$ and the threshold voltage $V_{TH}$ of the driving transistor TD, and the node $N_S$ is charged to be the voltage of the data signal $V_{DATA}$. In detail, the second scanning signal $V_{SCAN2}$ and the emitting control signal $V_{EM}$ are low level signals, and the first scanning signal $V_{SCAN1}$ and the third scanning signal $V_{SCAN3}$ are high level signals. Usually, a voltage difference between a voltage of the first scanning signal $V_{SCAN1}$ and a voltage of the data signal $V_{DATA}$ is higher than a threshold voltage of the first transistor T1 and a voltage difference between a voltage of the first voltage $V_{DD}$ and a voltage of the data signal $V_{DATA}$ is higher than a threshold voltage of the driving transistor TD. On this basis, $V_{GS}$ of the first transistor T1 is higher than $V_{TH}$ of the first transistor T1, and the first transistor T1 is conducted. Moreover, the potential of the node $N_S$ is the voltage value of the data signal $V_{DATA}$. Similarly, the driving transistor TD is conducted, and the potential of the node $N_D$ is also the voltage value of the data signal $V_{DATA}$. Similarly, the third transistor T3 is conducted, an end of the driving capacitor $C_{ST}$, being connected to the third transistor T3, discharges electricity to the data line through the third transistors T3, the driving transistor TD and the first transistor T1 in turn, and the potential of the driving capacitor is gradually reduced. When the potentials of the node $N_D$ and $N_G$ are reduced to the sum ($V_{DATA}$+$V_{TH}$) of the voltage of the data signal $V_{DATA}$ and the threshold voltage $V_{TH}$ of the driving transistor TD, the $V_{GS}$ of the driving transistor TD is equal to $V_{TH}$ of the driving transistor TD, and in this case, the driving transistor TD is turned off. Thus, voltages of the node $N_D$ and $N_G$ remain at ($V_{DATA}$+$V_{TH}$), and the potential of node $N_S$ is equal to the voltage value of the data signal $V_{DATA}$.

Figure 6B:
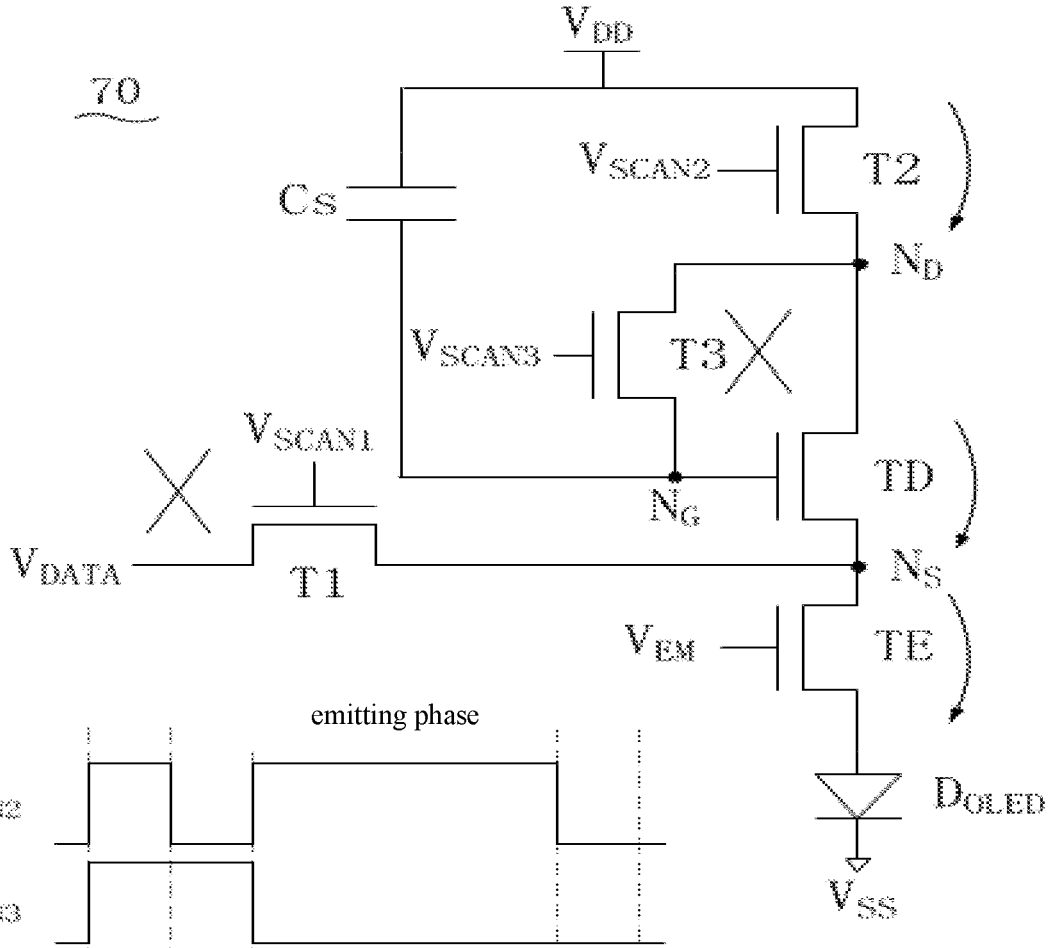
FIG. 6*b* is a schematic diagram of a pixel circuit in FIG. 3 at an emitting phase of the timing diagram.
Figure 6A:
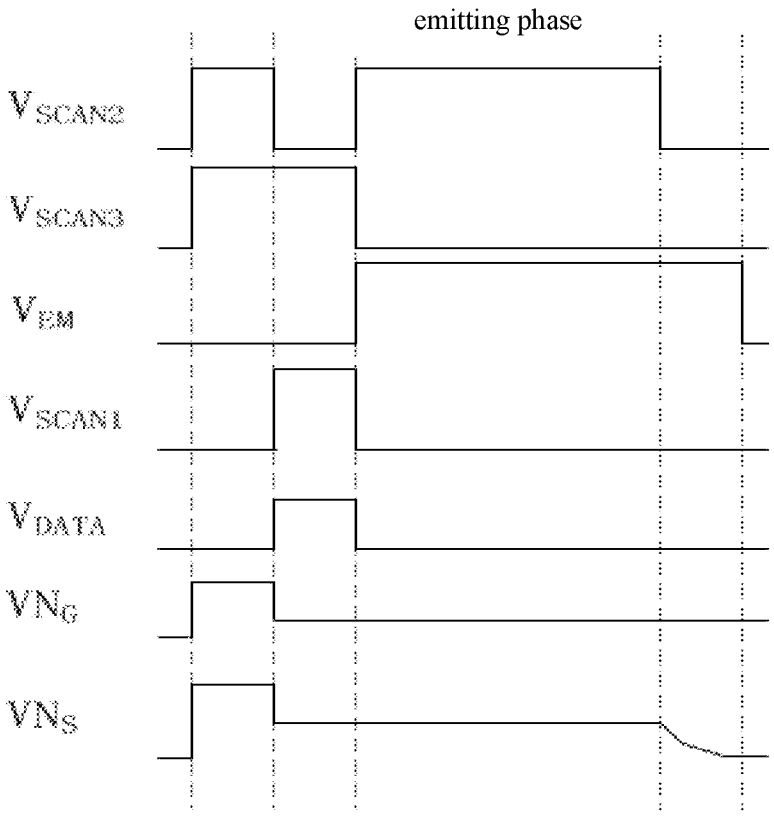
FIG. 6*a* is a timing diagram of a pixel circuit in FIG. 3.

Referring to FIG. 6*a* and FIG. 6*b*, at a third phase (i.e., an emitting phase), the second transistor T2, the driving transistor TD and the emitting transistor TE are conducted, and the light-emitting diode $D_{OLED}$ emits light. In detail, an operating condition of the pixel circuit 70 at the emitting phase is illustrated in FIG. 6*b*. At the emitting phase, the second scanning signal $V_{SCAN2}$ and the emitting control signal $V_{EM}$ are high level signals, the third scanning signal $V_{SCAN3}$ and the first scanning signal $V_{SCAN1}$ are low level signals. In this case, the second transistor T2 and the emitting transistor TE are turned on, and the first transistor T1 and the third transistor T3 are cut off. Since there is no circuit, the voltage of the driving capacitor $C_{ST}$ remains unchanged, i.e., the potential of the node $N_G$ is maintained at ($V_{DATA}$+$V_{TH}$), the driving transistor TD is conducted by the power stored in the driving capacitor $C_{ST}$, and a current generated by the first voltage $V_{DD}$ flows through the light-emitting diode $D_{OLED}$ to emit light. According to the formula 1 mentioned in the background, the current flowing through the light-emitting element is:

$$I_{OLED} = 1/2 * \beta(V_{DATA} + V_{TH} - V_{TH})^2$$
$$= 1/2 * \beta(V_{DATA})^2$$

Figure 8:
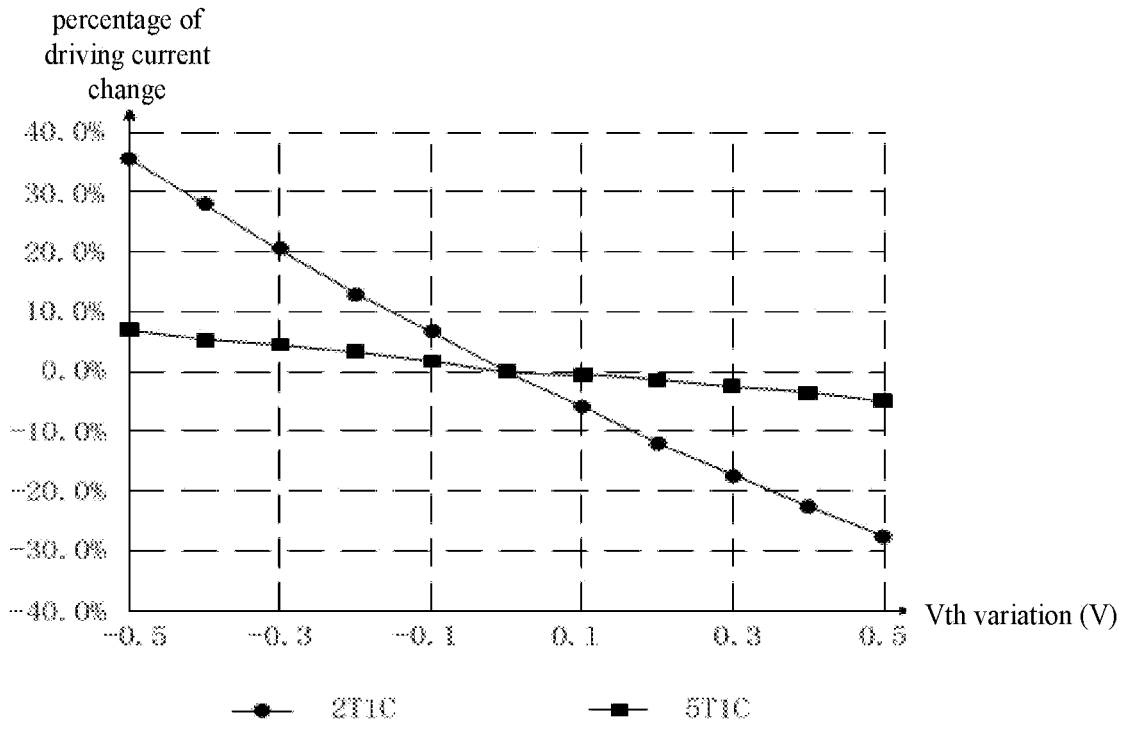
FIG. 8 is a schematic diagram illustrating a relationship between a threshold voltage of the driving transistor of the pixel circuit in FIG. 3 and a change of a current.

It can be seen from above formula that, in the emitting phase, the current flowing through the light-emitting element is only related to the data signal $V_{DATA}$, so that the influence of the change of the threshold voltage on current flowing through the light-emitting element is reduced. As illustrated in FIG. 8, compared with the 2T1C structure in the related art, a current change of a 4T1C structure of the present disclosure is reduced significantly under a same change of the threshold voltage $V_{TH}$, thereby improving uniformity of brightness of the display panel 8.

Figure 7B:
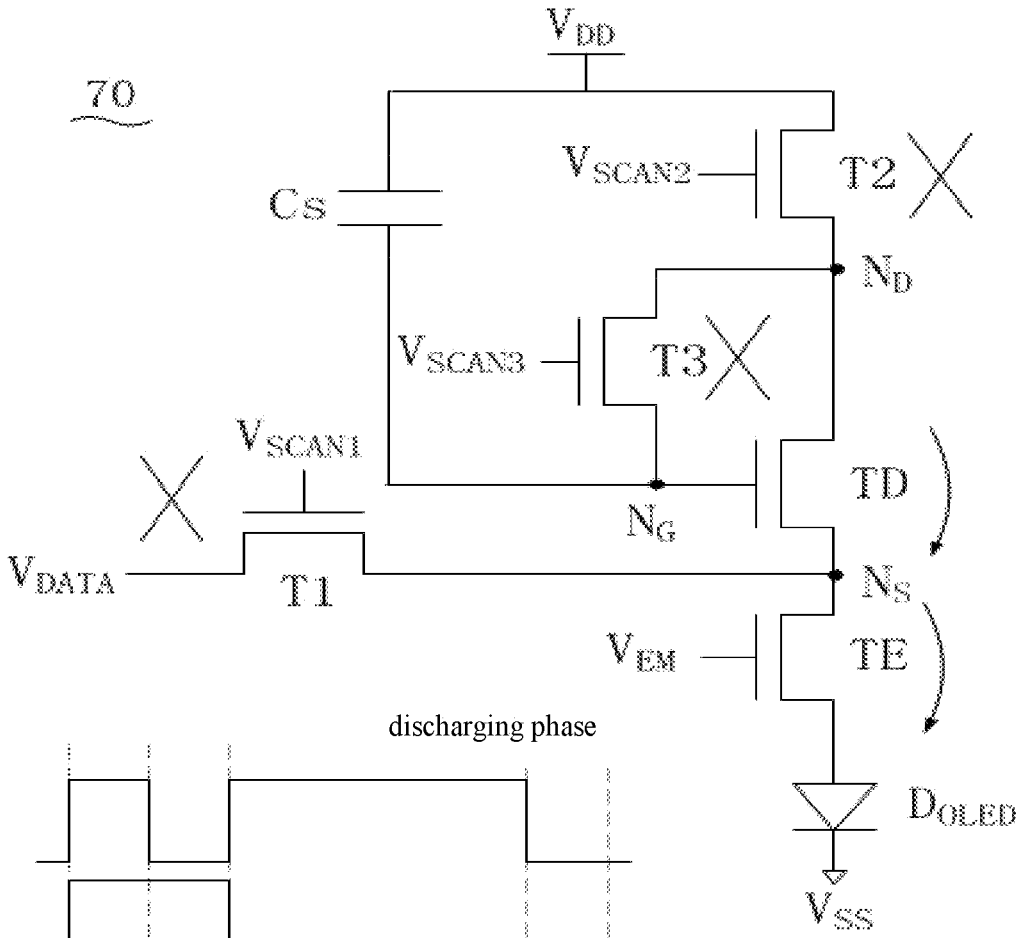
FIG. 7*b* is a schematic diagram of a pixel circuit in FIG. 3 at a discharging phase of the timing diagram.
Figure 7A:
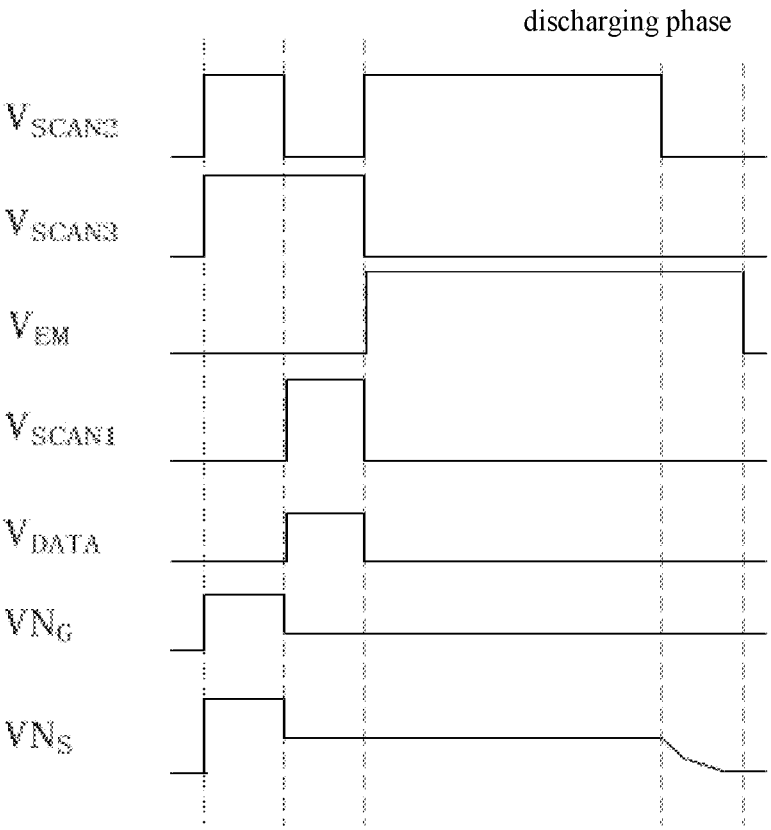
FIG. 7*a* is a timing diagram of a pixel circuit in FIG. 3.

In an embodiment of the present disclosure, referring to FIG. 7*a* and FIG. 7*b*, at a fourth phase (i.e., a discharging phase), the driving capacitor $C_{ST}$ discharges electricity to the second power line. In detail, at the electricity discharging phase, an operating condition of the pixel circuit 70 is illustrated in FIG. 7*b*. The emitting control signal $V_{EM}$ is a high level signal, and the first scanning signal $V_{SCAN1}$, the second scanning signal $V_{SCAN2}$ and the third scanning signal $V_{SCAN3}$ are low level signals. In this case, the emitting transistor TE is conducted, and since the potential of the node $N_G$ is still remained at ($V_{DATA}$+$V_{TH}$), the driving transistor TD is also conducted and the first transistor T1, the second transistor T2 and the third transistor T3 are turned off. The light-emitting diode $D_{OLED}$ is conducted at original potential, so that potentials of the node $N_D$ and the node $N_S$ are gradually reduced along with the second voltage $V_{SS}$. In this way, a case that the data voltage is written slowly or even unable to be written in a next compensating phase when the data voltage of the next cycle is too low (i.e., the data voltage is lower than the voltage of the node $N_S$) may be avoided. Therefore, a response speed is improved, as well as a display effect.

Figure 9:
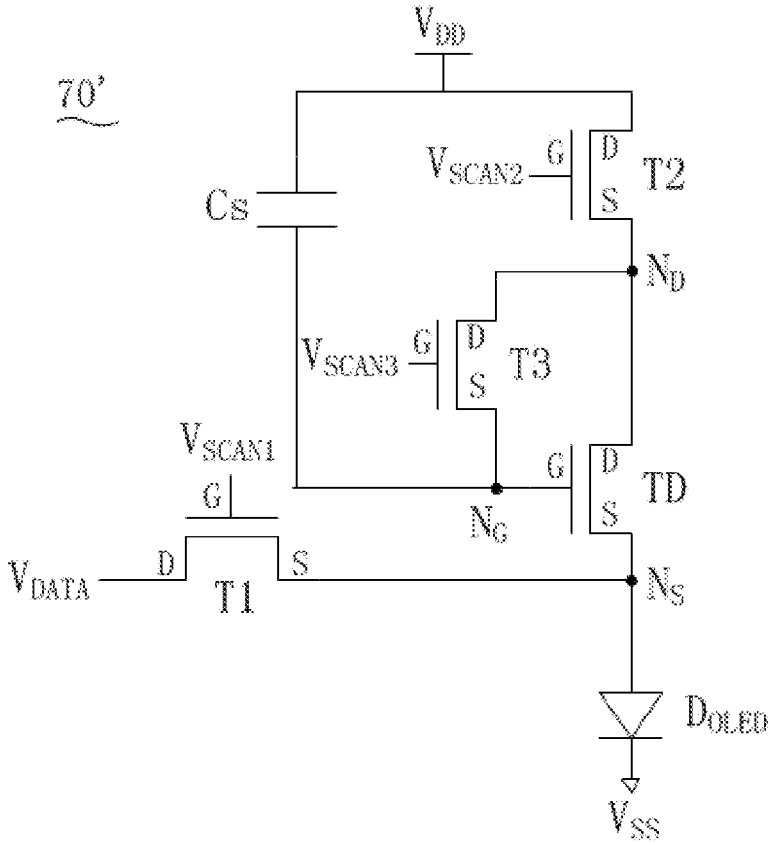
FIG. 9 is a schematic diagram of a pixel circuit of a display panel in FIG. 2 according to another embodiment of the present disclosure.
Figure 10B:
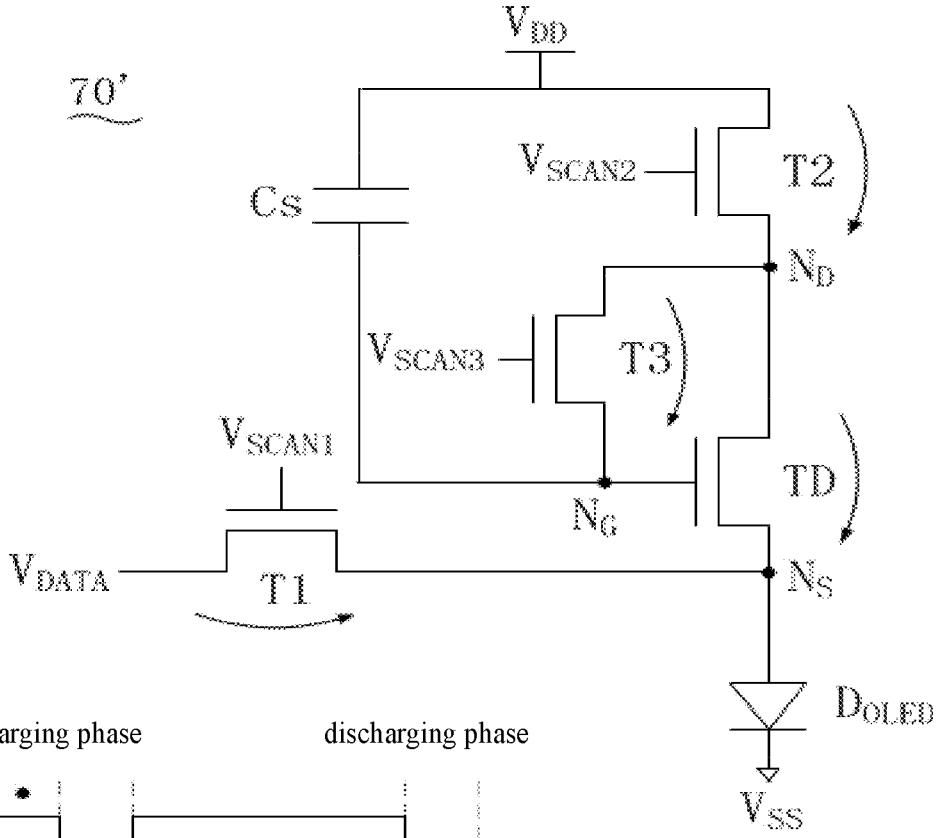
FIG. 10*b* is a schematic diagram of a pixel circuit in FIG. 9 at a charging phase of the timing diagram.
Figure 10A:
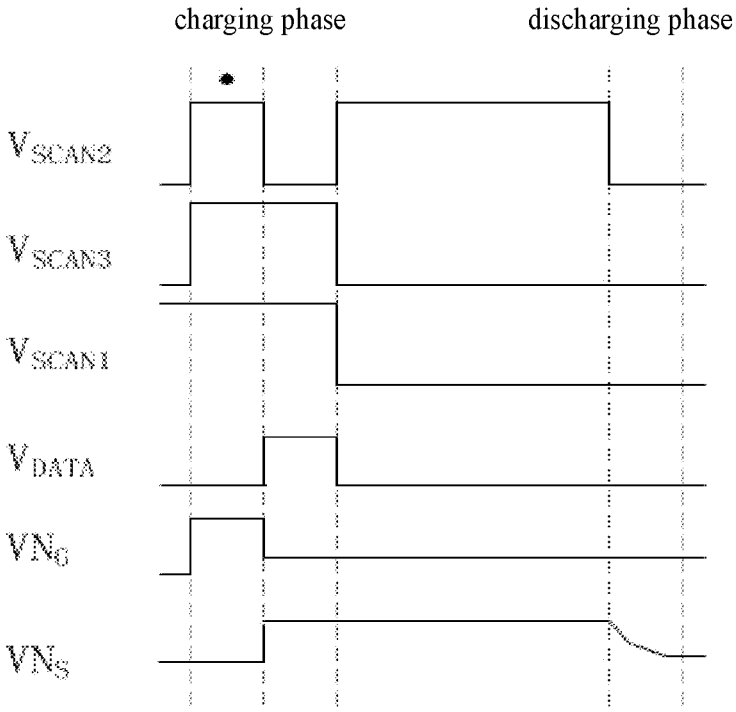
FIG. 10*a* is a timing diagram of a pixel circuit in FIG. 9.

In an embodiment of the present disclosure, referring to FIG. 9, a schematic diagram of another pixel circuit 70' is provided. The difference between the pixel circuit 70' and the pixel circuit 70 of the above embodiments lies in that the emitting transistor TE is omitted in the pixel circuit 70', and thus the driving transistor TD is directly connected to the light-emitting diode $D_{OLED}$. A driving timing diagram of the pixel circuit 70' is illustrated in FIG. 10*a*. At the charging phase, the voltage of the node $N_S$ is charged to the voltage of the data signal $V_{DATA}$, and voltages of the node $N_D$ and the node $N_G$ are charged to the voltage of the first voltage $V_{DD}$. In detail, the first scanning signal $V_{SCAN1}$, the second scanning signal $V_{SCAN2}$ and the third scanning signal $V_{SCAN3}$ are high level signals. In this case, the first transistor T1, the second transistor T2 and the third transistor T3 are conducted, and the driving transistor TD is conducted accordingly. In this case, the first voltage $V_{DD}$ is transmitted to the node $N_G$ through the second transistor T2 and the third transistor T3, i.e., both the node $N_G$ and the node $N_D$ are charged to be a voltage as the first voltage $V_{DD}$. Moreover, the first transistor T1 is conducted, and the potential of the node $N_S$ is the voltage of the data signal $V_{DATA}$. At a second phase, i.e., the compensating phase, the node $N_D$ and $N_G$ are charged to ($V_{DATA}$+$V_{TH}$), and the node $N_S$ is charged to the voltage of data signal $V_{DATA}$. At a third phase, i.e., an emitting phase, both the second transistor T2 and the driving transistor TD are conducted, and the light-emitting diode $D_{OLED}$ emits light. At the second and third phases, the operating principles and the operating processes are the same as those of the pixel circuit 70 in the above embodiments, which are not described in detail here. In an embodiment of the present disclosure, similar to the timing diagram of the pixel circuit 70 of the above embodiments, for the pixel circuit 70', a discharging phase may also be included after the third phase in the timing diagram, the operating mode and principle are the same as those of described above, which are not described in detail here.

The above descriptions are only preferred embodiment of the present disclosure, and cannot be construed to limit the present disclosure, and changes, alternatives, and modifications can be made in the embodiments without departing from spirit, principles and scope of the present disclosure.

What is claimed is:

1. A pixel circuit, comprising:

a light-emitting diode;

a driving transistor;

a first transistor connected between a data line and the driving transistor, a gate electrode of the first transistor being connected to a first scanning line, a drain electrode and a source electrode of the first transistor connected to the data line and a source electrode of the driving transistor respectively;

a second transistor connected between a first power line and the driving transistor;

a gate electrode of the second transistor being connected to a second scanning line;

a third transistor connected between a gate electrode of the driving transistor and the second transistor, a gate electrode of the third transistor being connected to a third scanning line; and a driving capacitor connected between the gate electrode of the driving transistor and the first power line, wherein the driving transistor is further connected to a second power line via the light-emitting diode.

2. The pixel circuit according to claim 1, wherein a drain electrode and a source electrode of the second transistor are connected to the first power line and a drain electrode of the driving transistor respectively.

3. The pixel circuit according to claim 1, wherein a drain electrode and a source electrode of the third transistor are connected to a drain electrode and the gate electrode of the driving transistor respectively.

4. The pixel circuit according to claim 1, wherein two ends of the driving capacitor are connected to the gate electrode of the driving transistor and the first power line respectively.

5. The pixel circuit according to claim 1, further comprising:

an emitting transistor connected between the driving transistor and the light-emitting diode, a gate electrode of the emitting transistor being connected to an emission line.

6. The pixel circuit according to claim 5, wherein a drain electrode and a source electrode of the emitting transistor are connected to a source electrode of the driving transistor and an anode of the light-emitting diode respectively, a cathode of the light-emitting diode is connected to the second power line.

7. A method for driving the pixel circuit according to claim 1, the driving transistor having a threshold voltage, the method comprising:

conducting the first transistor, the second transistor, the third transistor and the driving transistor, such that potentials at both ends of the driving capacitor are the first voltage provided by the first power line;

conducting the first transistor, the third transistor and the driving transistor, and cutting off the second transistor, such that a data voltage is output by the data line to the driving transistor via the first transistor, the driving capacitor discharges electricity to the data line via the third transistor, the driving transistor and the first transistor in turn until a potential of an end of the driving capacitor connected to the driving transistor being the sum of the data voltage and the threshold voltage; and conducting the second transistor, and cutting off the first transistor and the third transistor, such that the driving transistor is driven to be conducted by the driving capacitor, and a light-emitting element is driven to emit light by the first voltage provided by the first power line;

after the light emitting element emits light, cutting off the first transistor, the second transistor and the third transistor, such that the driving transistor is driven to be conducted by the driving capacitor, and a voltage of a connecting node between the driving transistor and the first transistor is decreased.

8. A method for driving the pixel circuit according to claim 5, the driving transistor having a threshold voltage, the method comprising:

conducting the second transistor and the third transistor, and cutting off the first transistor and the emitting transistor, such that potentials at both ends of the driving capacitor are the first voltage provided by the first power line;

conducting the first transistor, the third transistor and the driving transistor, and cutting off the second transistor, such that a data voltage is output by the data line to the driving transistor via the first transistor, the driving capacitor discharges electricity to the data line via the third transistor, the driving transistor and the first transistor in turn until a potential of an end of the driving capacitor connected to the driving transistor being the sum of the data voltage and the threshold voltage; and conducting the second transistor, and cutting off the first transistor and the third transistor, such that the driving transistor is driven to be conducted by the driving capacitor, and a light-emitting element is driven to emit light by the first voltage provided by the first power line;

after the light-emitting element emits light, cutting off the first transistor, the second transistor and the third transistor, such that the driving transistor is driven to be conducted by the driving capacitor, and a voltage of a connecting node between the driving transistor and the first transistor is decreased.

* * * * *